US005799463A

United States Patent [19]

Kashiba

[11] Patent Number: 5,799,463

[45] Date of Patent: Sep. 1, 1998

[54] METHOD FOR PRESERVATION OF ARTICLE

[75] Inventor: Takashi Kashiba, Kanagawa-ken, Japan

[73] Assignee: Mitsubishi Gas Chemical Company, Inc., Tokyo, Japan

[21] Appl. No.: 858,581

[22] Filed: May 19, 1997

[30] Foreign Application Priority Data

May 28, 1996 [JP] Japan ..... 8-133537

[51] Int. Cl.[6] ..... B65B 31/00; B65B 29/00

[52] U.S. Cl. ..... 53/400; 53/434; 53/440

[58] Field of Search ..... 53/432, 434, 400, 53/440

[56] References Cited

U.S. PATENT DOCUMENTS

| | | | |
|---|---|---|---|
| 3,169,068 | 2/1965 | Bloch | 53/400 X |
| 3,415,702 | 12/1968 | Bauder | 53/400 X |
| 3,597,237 | 8/1971 | Nughes | 53/440 X |
| 4,406,813 | 9/1983 | Fujishima | 252/188.28 |
| 4,711,741 | 12/1987 | Fujishima | 252/188.28 |
| 4,899,517 | 2/1990 | Shima et al. | 53/400 X |

FOREIGN PATENT DOCUMENTS

| | | | |
|---|---|---|---|
| 0 294 165 | 12/1988 | European Pat. Off. . | |
| 0 380 319 | 8/1990 | European Pat. Off. . | |
| 0 413 105 | 2/1991 | European Pat. Off. . | |
| 2669605 | 5/1992 | France | 53/440 |
| 1069929 | 5/1967 | United Kingdom | 53/400 |
| WO 94/07379 | 4/1994 | WIPO . | |

*Primary Examiner*—Linda Johnson

*Attorney, Agent, or Firm*—Frishauf, Holtz, Goodman, Langer & Chick, P.C.

[57] ABSTRACT

There is disclosed a method for the preservation of an article by housing an article such as a food, cereal and pharmaceutical in a packaging vessel which is equipped at least in part thereof with an oxygen absorbing resin layer wherein an iron-based deoxidizing agent is kneaded with and dispersed in a theremoplastic resin so that oxygen is absorbed in the layer in the presence of carbon dioxide gas and by hermetically sealing the packaging vessel. It is preferable to house the article in the vessel, subsequently replace the atmosphere in the vessel with carbon dioxide gas, etc. so as to allow carbon dioxide gas to be present therein and thereafter hermetically seal the vessel. The method enables substantially oxygen-free state by the absorption of oxygen in an atmosphere containing carbon dioxide gas and permits the deoxidizing agent packaging through carbon dioxide gas replacement as well as the deoxidizing agent package of an article which generates carbon dioxide gas from itself.

19 Claims, No Drawings

METHOD FOR PRESERVATION OF ARTICLE

BACKGROUND OF THE INVENTION

1. Field of the Invention

The present invention relates to a method for the preservation of an article which comprises hermetically enclosing an article in a packaging vessel equipped with an oxygen absorbing resin layer. More particularly, it pertains to a method for the preservation of an article which comprises preserving an article in a substantially oxygen-free state through oxygen absorption in the presence of carbon dioxide gas by housing the article in a packaging vessel and hermetically sealing the packaging vessel, which is equipped at least in part thereof with an oxygen absorbing resin layer wherein an iron-based deoxidizing agent is kneaded with and dispersed in a thermoplastic resin so as to absorb oxygen in said layer.

2. Description of the Related Arts

There has recently been established a packaging technique by the use of a deoxidizing agent, that is, a deoxidizing agent packaging technique as one of packaging techniques for articles, which technique has been applied to the preservation of not only food and pharmaceuticals but also a variety of articles, thus finding a wide use in various fields. By the term "deoxidizing agent packaging technique" as used herein is meant a technique which prevents qualitative deterioration of an article attributable to the presence of oxygen by maintaining, under an anaerobic condition, the inside of a packaging vessel wrapping an article to be preserved by the use of an deoxidizing agent. According to the aforesaid technique, it is made possible in the case of food, to contrive the prevention of oxidative deterioration of food, oxidation of fat and oil, color change or fading, insect damage and propagation of bacteria or mildew and the preservation of flavor and in the case of pharmaceuticals, to contrive the prevention of oxidation and discoloration. It being so, according to the deoxidizing agent packaging technique, it is made possible to preserve an article for a long period of time, while maintaining the quality of the article in a favorable state.

The deoxidizing agent to be used for deoxidizing agent packaging comprises an deoxidizer composition comprising as a principal component, a reducing substance having oxygen absorbing capability. The agent is usually used in the form of an oxidizing agent package in which the deoxidizer composition in the form of powder or granule is packed in an air-permeable small bag. As the deoxidizing agent, there have heretofore been proposed various deoxidizer compositions. At the present time, however, there is most prevalently used an iron powder-based deoxidizing agent which comprises iron powders as the principal component from the viewpoints of safety, oxygen absorbing efficiency and cost. Nevertheless, as will be described hereunder, even the excellent iron powder-based deoxidizing agent is not necessarily satisfactory in an atmosphere in which carbon dioxide gas is present.

There is available carbon-dioxide-gas replacement packaging as one of the packaging techniques. The aforesaid packaging, which is effective for maintaining the reddish tinge of meat, and the flavors of a sponge cake (Castella) and a steamed cake, and preserving pharmaceuticals, is widely put into practice for the purpose of qualitatively preserving foods and pharmaceuticals. The above-mentioned carbon-dioxide-gas replacement packaging not only aims at the working effect on quality preservation by the use of carbon dioxide gas, but also is intended to remove oxygen in a packaging vessel by gas replacement. It is therefore, thought that the combinational use of the carbon-dioxide-gas replacement packaging and a deoxidizing agent brings about an extremely effective method. In this case, however, the iron powder-based deoxidizing agent is remarkably inhibited in its oxygen absorbing capability by carbon dioxide gas, whereby the oxygen abosorbing rate is lowered, thus a long time is required to remove residual oxygen in the vessel, or oxygen absorption is discontinued on the way thereof in some cases.

Carbon dioxide gas is sometimes generated from fermented food such as cheese and yoghurt and agricultural product such as beans and cereals during preservation in a packaging vessel, and is frequently generated by a heating treatment such as a retorting treatment. In the case where such a product which generates carbon dioxide gas is subjected to deoxidizing agent packaging by the use of the iron powder-based deoxidizing agent, the agent is also adversely influenced by the generation of the carbon dioxide gas. In the case of violent generation of carbon dioxide gas, the iron powder-based deoxidizing agent is inevitably inhibited markedly in its oxygen absorbing capability as is the case with the foregoing, thereby failing to achieve the object of the deoxidizing agent packaging. Even in the case where an oxygen-free state has been attainable during a limited period after packaging because of a slight amount of generated carbon dioxide gas, a subsequent increase in the concentration of the carbon dioxide gas makes it impossible to sufficiently absorb oxygen penetrating from outside also to maintain substantially oxygen-free state, with the result that longterm object of the deoxidizing agent packaging can not be achieved as well.

As mentioned above, the iron powder-based deoxidizing agent involves the problem in that it fails to sufficiently function in an atmosphere containing carbon dioxide gas, since it is adversely influenced by the gas and its oxygen absorbing capability is seriously inhibited. Under such circumstances, it has eagerly been desired to develop a deoxidizing agent packaging technique for a system containing carbon dioxide gas.

SUMMARY OF THE INVENTION

It is an object of the invention to provide a method for preserving an article which is capable of efficiently absorbing oxygen in an atmosphere containing carbon dioxide gas to constitute a substantially oxygen-free state by solving the above-mentioned problems of the prior art that the iron powder-based deoxidizing agent fails to sufficiently function in an atmosphere containing carbon dioxide gas and which is capable of realizing deoxidizing agent packaging by replacement with carbon dioxide gas and at the same time, deoxidizing agent packaging for an article from which carbon dioxide gas is generated.

In view of the foregoing, intensive research and investigation were made by the present inventors in order to solve the above-mentioned problems with the previous deoxidizing agent packaging techniques. As a result, it has been found that an oxygen absorbing resin composition wherein an iron powder-based deoxidizing agent is kneaded with and dispersed in a thermoplastic resin sufficiently exhibits oxygen absorbing capability in an atmosphere containing carbon dioxide gas. The present invention has been accomplished by the above-mentioned finding.

Specifically, the present invention provides a method for the preservation of an article which comprises preserving an article in a substantially oxygen-free state through the absorption of oxygen in the presence of carbon dioxide gas by housing the article in a packaging vessel and hermetically sealing the packaging vessel, which is equipped at least in part thereof with an oxygen abosorbing resin layer wherein an iron-based deoxidizing agent is kneaded with and dispersed in a thermoplastic resin so that oxygen is absorbed in said layer.

DESCRIPTION OF THE PREFERRED EMBODIMENTS

The packaging vessel according to the present invention is a vessel equipped at least in part thereof with an oxygen absorbing resin layer so as to absorb oxygen in the vessel, and the oxygen absorbing resin layer is a resin composition layer in which an iron-based deoxidizing agent is kneaded with and dispersed in a thermoplastic resin. The oxygen absorbing resin layer to be used is usually in the form of a laminate in which a protective layer is arranged on the surface, that is, the internal surface of the vessel so that an article to be packaged may not come into direct contact with the resin layer. The oxygen absorbing resin layer in which an iron-based deoxidizing agent is kneaded with and dispersed in a thermoplastic resin is sometimes simply referred to as "Oxygen absorbing resin layer".

In the present invention, the packaging vessel may be a vessel composed in part or in whole of a laminate containing an Oxygen absorbing resin layer, or may be a vessel equipped therein with a laminate containing the Oxygen absorbing resin layer. Alternatively, the packaging vessel may be a packaging bag comprising a multi-layer film containing the Oxygen absorbing resin layer.

The Oxygen absorbing resin layer relating to the present invention is capable of absorbing oxygen even in an atmosphere containing carbon dioxide ($CO_2$) gas. Thus according to the method of the present invention, it is made possible to preserve an article in an atmosphere containing $CO_2$ gas substantially without containing oxygen while oxygen in the vessel is absorbed, by housing the article in the packaging vessel, replacing the vessel inside with $CO_2$ gas and thereafter hermetically sealing the vessel.

As a preferred embodiment of the present invention, mention is made of a method which comprises housing an article in the packaging vessel, replacing the vessel inside with $CO_2$ gas, hermetically sealing the vessel and thereafter preserving said article at a low temperature. The preservation temperature in this method is preferably 15° C. or lower, more preferably 10° C. or lower, particularly preferably 5° C. or lower.

According to the present invention, it is made possible in the preservation of an article, especially a food to provide the effects on bacteria control and color preservation by $CO_2$ gas and in addition, to exert further excellent preservability by the combination of the present method and nitrogen replacement method or vacuum packaging method.

The method according to the present invention is preferably applied to an article which generates $CO_2$ gas. Such article may be that which generates $CO_2$ gas by heating. According to the method of the present invention in this case, the article is housed in the packaging vessel, which is then hermetically sealed, followed by heating. Alternatively, the article which has been heated in advance is housed in the packaging vessel, which is then hermetically sealed.

In the case of preserving a food prone to premature deterioration of quality such as animal meat and fermented food by the method according to the present invention, the initial oxygen concentration can be decreased by the combinational use of the present method and gas replacement such as replacement with $CO_2$ gas or nitrogen ($N_2$) gas. In order to render the vessel inside oxygen-free as early as possible, the initial oxygen concentration is preferably as low as possible. Although the concentration varies depending upon the circumstance, it is preferably at most 5%, particularly preferably at most 1%.

The method according to the present invention is preferably combined with gas replacement, especially replacement by $CO_2$ gas. The combinational use of the present method and $CO_2$ replacement along with the utilization of the packaging vessel according to the present invention enables to demonstrate the effects on the color preservation and bacteria control for animal meat, flavor preservation for cakes such as a sponge cake, prevention of qualitative deterioration for pharmaceuticals, and the like.

Since the packaging vessel relating to the present invention is capable of demonstrating the specific performance irrespective of the presence of $CO_2$ gas in the vessel, the $CO_2$ gas concentration in the vessel for $CO_2$ gas replacement is not specifically limited, but is preferably at least 1%, more preferably at least 5%. In order to decrease the initial concentration of oxygen in the vessel, $CO_2$ gas concentration in the vessel may be set on 30% or higher by the replacement with $CO_2$ having a high concentration.

The method according to the present invention, which is well suited for the deoxidizing agent packaging of articles that generate $CO_2$ or that are suitably preserved in an atmosphere of $CO_2$ gas, is applicable to the preservation of foods exemplified by processed animal meat, vegetables, fruits, fishery products, fermented foods such as cheese and yoghurt, cakes such as sponge cakes and steamed cakes, beans and cereals and such articles as cosmetics, soaps, etc.

The Oxygen absorbing resin layer to be arranged in the packaging vessel according to the present invention comprises a resin composition in which an iron-based deoxidizing agent is kneaded with and dispersed in a thermoplastic resin. The thermoplastic resin needs only be a thermoplastic resin capable of absorbing oxygen when kneaded with an iron-based deoxidizing agent, and is examplified by low density polyethylene, intermediate density polyethylene, high density polyethylene, polypropylene, propylene/ethylene copolymer, ethylene/vinyl acetate copolymer, olefinic resin such as a blend thereof, and styrenic resin such as polystyrene, styrene/butadiene copolymer and styrene/isoprene copolymer. The thermoplastic resin may be used alone or as a component of a blend with at least one other.

As the iron powder-based deoxidizing agent to be incorporated in the thermoplastic resin, there is usable a publicly known deoxidizing agent comprising iron powder and a halogenated metal. Examples of usable iron powder include those obtained by any of various production process such as reduced iron powder and sprayed iron powder. The particle diameter of the iron powder is preferably in the range of 10 to 50 μm and is limited in its maximum particle diameter in consideration of the processing of the Oxygen absorbing resin layer. Examples of the preferably usable halogenated metal include a halogenide of any of an alkali metal and an alkaline earth metal which is exemplified by sodium chloride, sodium bromide, sodium iodide, potassium chloride, potassium iodide, potassium bromide, calcium chloride, magnesium chloride and barium chloride. The aforementioned halogenated metal may be used alone or in combination with at least one other.

The blending ratio of the halogenated metal to the iron powder is preferably 0.05 to 50, more preferably 0.1 to 20 parts by weight based on 100 parts by weight of the iron powder. The halogenated metal, when blended in an amount of less than 0.05 part by weight, fails to exhibit the oxygen absorbing capability. On the contrary, the halogenated metal, when blended in a amount of more than 50 parts by weight, sometimes arrests oxygen absorption by an excessive absorption of moisture because of the excessive amount for oxygen absorption reaction. At any rate, the blending ratio departing from the above-prescribed range is unfavorable.

The oxygen absorbent, that is, the deoxidizing agent comprising iron powder and the halogenated metal may be produced by simply mixing the both or by coating the surfaces of the iron powder with the halogenated metal by any of various available methods. It is possible to adopt a method in which the iron powder and powdery halogenated metal are directly mixed with the oxygen absorbing resin.

The blending ratio of the oxygen absorbent to the thermoplastic resin is preferably at most 80%, more preferably in the range of 20 to 50% by weight based on the thermoplastic resin. The oxygen absorbent, when blended in an unreasonably low ratio, fails to assure oxygen absorbing capability. The absorbent, when blended in an unreasonably high ratio, deteriorates the moldability or strength of the sheet or film produced from the thermoplastic resin, thereby making it impossible to produce an appropriate sheet or film. For this reason, the blending ratio of the oxygen absorbent is properly selected within the aforesaid range in response to the oxygen absorbing capability and the method for processing the Oxygen absorbing resin layer. The Oxygen absorbing resin layer may be incorporated, in addition to the oxygen absorbent, with an alkaline earth metal oxide for enhancing the preservability and processability, a gas adsorbent as a countermeasure against malodorous components, a colorant, a filler and the like, each being dispersed in the layer.

The Oxygen absorbing resin layer according to the present invention is constituted by kneading the iron-based deoxidizing agent with the thermoplastic resin and dispersing thereinto, and is made into a laminate which is equipped, on at least one side, with an oxygen-permeable protective layer so that the layer may not be brought into direct contact with an article to be packaged. The resultant laminate is used in the form of multi-layer sheet or film, for processing into a packaging vessel such as a vessel and bag. The thickness of the Oxygen absorbing resin layer is not specifically limited, but is preferably in the range of 0.1 to 3 mm.

The Oxygen absorbing resin layer may be made into a single-layer film or sheet by means of a method such as T-dye method and ring dye method. According to the demand, the layer may be laminated, on one side, with a protective layer of thermoplastic resin to constitute an inner layer of the vessel, and on the other side, with a gas barrier layer of a gas barrier resin, a metallic foil or the like to constitute an outer layer of the vessel. As a result, a multi-layer sheet or film can be formed. Preferably the multi-layer sheet or film is produced by laminating a protective layer (oxygen-permeable), the Oxygen absorbing resin layer, and a gas barrier layer (oxygen barrier) in this order, or by further placing an intermediate layer between the above-mentioned layers as desired.

As the laminating method, there is adoptable any of the publicly known methods such as wet lamination, dry lamination and extrusion lamination. The multi-layer sheet or film can be formed by simultaneously extruding the resins of the respective layers through coextrusion method.

The Oxygen absorbing resin layer, which is formed in the above-mentioned manner, should be an unoriented film or sheet. The layer of an oriented film or sheet is liable to generate voids on the surface thereof, thereby making it difficult to achieve the predeterminate object. In addition, the multi-layer sheet or film is preferably formed from an unoriented sheet or film as a whole.

For the protective layer to be arranged on the Oxygen absorbing resin layer, there is usable the thermoplastic resin which is used for the Oxygen absorbing resin layer. It is also possible to add, to the protective layer, a resin such as polyvinyl alcohol, polystyrene and ionomer or to make it multi-layered in order to impart sealability and peelability to the protective layer.

There are used, as the gas barrier layer, a gas barrier resin such as ethylene/vinyl alcohol copolymer; nylon; and polyvinylidene chloride, a metallic foil such as aluminum foil, a metal, a metal oxide vapor deposited film and the like.

The articles to which the method according to the present invention are applied, are each preferably an article containing moisture and capable of supplying the Oxygen absorbing resin layer with moisture so that the iron-based deoxidizing agent dispersed in the Oxygen absorbing resin layer exhibits oxygen absorbing capability by acquiring moisture.

The articles to which the preservation method according to the present invention are well suited, are those mentioned hereinbefore. Among them, specific examples of the articles which can exert more efficient preservation effect by replacing the vessel inside with $CO_2$ gas include foods such as cereals, raw meat, sausage, ham and cake and pharmaceuticals such as transfusion fluid. Specific examples of the articles which generate $CO_2$ gas from themselves include agricultural products such as beans and cereals and fermented food such as cheese, yoghurt, fermented soybeans and Korean pickles. Specific examples of the foods which generate $CO_2$ gas from themselves by the decomposition of oil components or the influence of an inflating agent at the time of heating treatment include hamburger, fried bean curd, skewered grilled chicken, a bun with a bean-jam filling, croquette, American hot dog, fried or steamed dumpling stuffed with minced pork, sponge cake and steamed cake.

The articles to which the method according to the present invention are applied, are not limited to the abovementioned foods, cereals and pharmaceuticals but may include the articles capable of achieving the predeterminate object by the application of the method of the invention.

As is clear from the foregoing description, as opposed to the conventional iron powder-based deoxidizing agent which is deteriorated in deoxidizing performance by the influence of $CO_2$ gas, the packaging vessel and bag according to the present invention can easily absorb oxygen even in the presence of $CO_2$ gas by virtue of its specific constitution of the vessel and bag comprising the Oxygen absorbing resin layer in which the deoxidizing agent is kneaded with and dispersed in the thermoplastic resin to impart deoxidizing capability to the vessel and bag. That is to say, the packaging vessel according to the present invention is characterized by its being capable of exerting its deoxidizing capability even in an atmosphere containing $CO_2$ gas.

According to the method of the present invention, it is made possible to properly preserve such articles as cereals and pharmaceuticals by readily absorbing oxygen in an atmosphere of preserving such articles, particularity in the case of preserving the articles that are liable to qualitative deterioration due to oxygen and are preserved by $CO_2$ replacement, the articles which generate $CO_2$ gas from themselves in the course of preservation and the articles which generate $CO_2$ gas from themselves by heating treatment.

In the following, the present invention will be described in more detail with reference to comparative examples and working examples, which however shall not limit the present invention thereto.

EXAMPLE 1

A deoxidizing agent was kneaded and pelletized which was composed of polypropylene (PP) having a melt index (MI) of 0.5 g/10 minutes at 230° C. and iron powder having an average particle diameter of 30 μm coated with 1% by weight of calcium chloride at a ratio by weight of 60:40, by the use of a pelletizer constituted of a twin-screw extruder having two built-in screws of 50 mm in diameter, a strand die, a blower cooler and a cutter.

Subsequently, there were coextruded by the use of the extruder, four kinds of materials including PP having an MI of 0.5 g/10 minutes at 230° C.; the above-pelletized resin composition comprising PP and iron-based deoxidizing agent; ethylene/vinyl alcohol copolymer having an ethylene content of 35% and a degree of saponification of 99.6%; and a maleic anhydride-modified PP having an MI of 0.5 g/10 minutes at 230° C. to form six-layer sheet comprising a PP layer in 100 μm thickness as the innermost layer; an Oxygen absorbing resin layer containing the iron-based oxygen absorber in 200 μm thickness as the first intermediate layer; a maleic anhydride-modified PP layer in 30 μm thickness as the first adhesive layer; an ethylene/vinyl alcohol copolymer layer (EVOH layer) in 40 μm thickness as the second intermediate layer; a maleic anhydride-modified PP layer in 30 μm thickness as the second adhesive layer; and a PP layer in 400 μm thickness as the outermost layer in that order making an overall thickness of 800 μm.

By the use of a vacuum molding machine, the resultant multi-layer sheet was molded at around 190° C., into a rectangular tray type vessel having a major axis length of 130 mm, a minor axis length of 100 mm and a depth of 25 mm in which the first intermediate layer was located inside the second intermediate layer.

<Preservation test for food (green ham)>

Green ham having a water activity of 0.98 in an amount of 150 g was placed in the above-mentioned tray type vessel, which was then hermetically sealed by heat-sealing the opening of the vessel with a lid composed of a gas-impermeable aluminum foil-made laminate. In hermetically sealing the vessel, the atmosphere in the vessel was replaced with a mixed gas of $CO_2$ gas and $N_2$ gas at a ratio of 7:3 so that the concentrations of oxygen and $CO_2$ gas became about 1% and 65%, respectively in the replaced stmosphere. The hermetically sealed tray type vessel which housed the green ham and whose atmosphere was replaced with $CO_2$ was preserved at a temperature of 10° C., and the oxygen concentration in the vessel was measured at a prescribed interval of days. The hermetically sealed tray type vessel was unsealed on the 7 th day from the sealing to examine the color tone and smell of the preserved ham in the vessel. The results are given in Table 1.

Comparative Example 1

The procedure in Example 1 was repeated to carry out the preservation test for green ham except that $N_2$ gas alone was used instead of the mixed gas of $CO_2$ gas and $N_2$ gas, so that the oxygen concentration became 1% in the replaced atmosphere. The results are given in Table 1. During the preservation period of time, no carbon dioxide gas was detected in the vessel.

Comparative Example 2

In a bag (130 mm×100 mm in size) in the form of laminate made of gas impermeable aluminum foil was housed 150 g of green ham having a water activity of 0.98 along with a deoxidizing agent package which had been prepared by packing a small bag made of waterproof oilproof Japanese paper having a unit weight of 50 g/m$^2$ (40 mm×40 mm in size) with 1 g of a deoxidizing agent composed of iron powder having an average particle diameter of 30 μm coated with 1% by weight of calcium chloride. The atmosphere inside the laminate bag was replaced with a mixed gas of $CO_2$ gas and $N_2$ gas at a ratio of 7:3 so that the concentrations of oxygen and $CO_2$ gas became about 1% and 65%, respectively, followed by hermetical sealing of the laminate bag. Thereafter the laminate bag was subjected to the preservation test in the same manner as in Example 1. The results are given in Table 1.

Comparative Example 3

The procedure in Comparative Example 2 was repeated to carry out the preservation test for green ham except that $N_2$ gas alone was used instead of the mixed gas of $CO_2$ gas and $N_2$ gas, so that the oxygen concentration became 1% in the replaced stmosphere. The results are given in Table 1. During the preservation period of time, no carbon dioxide gas was detected in the laminate bag.

TABLE 1

(Result of preservation test for green ham)

| | Example 1 | Comparative Example 1 | Comparative Example 2 | Comparative Example 3 |
|---|---|---|---|---|
| Packaging method | deoxidizable vessel with carbon dioxide gas replacement | deoxidizable vessel with nitrogen gas replacement | deoxidizing agent in gas barrier bag with carbon dioxide gas replacement | deoxidiazing agent in gas barrier bag with nitrogen gas replacement |
| Oxygen concentration (%) | | | | |
| 1st day | 0.31 | 0.35 | 1.06 | 0.18 |
| 3rd day | 0.06 | 0.07 | 0.81 | 0.05 |
| 7th day | 0.02 | 0.02 | 0.13 | 0.02 |
| Quality evaluation: | | | | |
| Flavor Remark 1) | 3 | 3 | 1 | 3 |
| Color tone Remark 2) | 3 | 1 | 1 | 1 |

Flavor Remark 1): 3; good 2; somewhat sour odor 1; remarkably sour odor
Color tone Remark 2): 3; reddish tinge 2; somewhat turned brownish 1; turned brownish In the case of Example 1, in spite of the presence of a large amount of $CO_2$ gas due to $CO_2$ gas replacement, the inside of the deoxdizable vessel according to the present invention was maintained under substantially oxygen-free condition and also in an atmosphere of $CO_2$ gas because of sufficient absorption of oxygen, whereby the green ham was preserved in a favorable brilliant state in quality without any impairement in its flavor without any change in color tone. On the other hand in Comparative Example 2, since the green ham along with the iron powder-based deoxidizing agent was placed in the gas barrier bag, followed by $CO_2$ gas replacement, the conventional deoxidizing agent package was adversely influenced by $CO_2$ gas, failing to sufficiently absorb oxygen and deteriorating the green ham quality. In Comparative Example 1 wherein the deoxidizable vessel was used and Comparative Example 3 wherein the gas barrier bag containing the deoxidizing package was used, the deoxidizing capability was sufficiently exhibited without being influenced by $CO_2$ gas owing to $N_2$ gas replacement. Nevertheless, A change in color tone of the green ham took place because of the preservation in the atmosphere being devoid of $CO_2$ gas.

EXAMPLE 2

The procedure in Example 1 was repeated to carry out the preservation test except that 200 g of cheese in place of the green ham was placed in the tray type vessel and that $N_2$ gas alone was used instead of the mixed gas of $CO_2$ gas and $N_2$ gas, so that the oxygen concentration became 1% in the replaced atmosphere. The results are given in Table 2.

Comparative Example 4

In a laminate bag made of aluminum foil same as the bag in Comparative Example 2 was housed 200 g of cheese along with a deoxidizing agent package same as in Comparative Example 2. The atmosphere inside the laminate bag was replaced with nitrogen gas so that the oxygen concentration became 1% in the replaced atmosphere. Thereafter the laminate bag was subjected to the preservation test in the same manner as in Example 1. The results are given in Table 2.

TABLE 2

(Result of preservation test for cheese)

| | Example 2 | | Comparative Example 4 | |
|---|---|---|---|---|
| Packaging method | deoxidizable bag with nitrogen gas replacement | | deoxidizing agent in gas barrier bag with nitrogen gas replacement | |
| Gas concentration (%) | $O_2$ | $CO_2$ | $O_2$ | $CO_2$ |
| 1st day | 0.31 | 2.4 | 1.35 | 2.2 |
| 3rd day | 0.06 | 2.8 | 0.96 | 2.4 |
| 7th day | 0.02 | 3.3 | 0.75 | 2.6 |
| Quality evaluation: | | | | |
| Flavor | good | | remarkably offensive odor | |

As is clear from the results in Table 2, there was recognized the generation of $CO_2$ gas from the cheese itself during the preservation period. In the case of Example 2, despite $CO_2$ gas generation, the inside of the preservation system was maintained under substantially oxygen-free condition because of favorable absorption of oxygen in the vessel, whereby the cheese was preserved in a satisfactory state in quality without any change in its flavor. As opposed to the foregoing, in the case of Comparative Example 4, the oxygen in the vessel was not sufficiently absorbed because of the influence of $CO_2$ gas, thereby causing qualitative deterioration accompanied by remarkable offensive-odor.

EXAMPLE 3

A deoxidizing agent was kneaded and pelletized which was composed of polypropylene (PP) having a melt index (MI) of 9.0 g/10 minutes at 230° C. and iron powder having an average particle diameter of 30 m coated with 1% by weight of calcium chloride at a ratio by weight of 60:40 by the use of the same pelletizer as in Example 1.

Then, a polypropylene (PP) film of 30 μm in thickness was laminated on each side of the film of 60 μm in thickness which had been formed by an extruder from the above-pelletized resin composition containing the iron-based oxygen absorbent. The resultant laminated film was laminated on one side with an aluminum foil of 10 μm in thickness, which was further laminated with a polyester film (polyethylene terephthalate PET film) of 10 μm in thickness to form a multi-layer oxygen absorbing film with layer constitution of PP (30 μm), oxygen absorbing resin layer (60 μm), PP (30 μm), aluminum foil (10 μm) and PET (10 μm) in that order making an overall thickness of 140 μm.

A laminated film of polyvinylidene chloride-coated nylon (KON) of 15 μm in thickness/polyethylene (PE) of 70 μm in thickness was superposed upon the resultant multi-layer oxygen absorbing film so that the PE came in contact with the PET of the oxygen absorbing film. Then the three sides of the superposed films were heat sealed so that the oxygen absorbing resin layer was located inwards to form a deoxidizable bag (150 mm×200 mm in size)

<Preservation test for amino acid transfusion>

In the deoxidizable bag produced in the above manner was housed an amino-acid transfusion bag in which the amino-acid transfusion was enclosed in a plastics bag. Then, the atmosphere in the deoxidizable bag was replaced with $CO_2$ gas, so that the concentrations of oxygen and $CO_2$ gas became 0.5% and 97%, respectively in the replaced atmosphere of the bag inside, followed by heat sealing of the bag. The deoxidizable bag in which the amino-acid transfusion was enclosed was treated by heating at 120° C. for 30 minutes by the use of an air-steam type high-temperature high-pressure sterilizing apparatus and thereafter preserved at 25° C. During the preservation period, measurements were made at a prescribed interval of days, of the concentrations of oxygen in the deoxidizable bag in which the amino-acid transfusion was enclosed. The bag was unsealed on the 7th day from the start of preservation to check for any change in the color tone of the amino-acid transfusion. The results are given in Table 3.

Comparative Example 5

A laminated film composed of polyvinylidene chloride-coated nylon (KON) of 15 μm in thickness/polyethylene (PE) of 70 μm in thickness as one side and an aluminum foil as the other side was made into a gas barrier bag (150 mm×200 mm in size) by heat-sealing three sides thereof. In this gas barrier bag were housed an amino-acid transfusion bag same as in the foregoing Example 3 and a deoxidizing agent package which had been prepared by filling 2 g of the iron-based deoxidizing agent prepared in Comparative Example 2 in a bag (50 mm×50 mm in size and 500 g/m$^2$·24 Hr ·atm in moisture permeability) formed by covering a bag made of Japanese paper/perforated polyethylene film with a laminate of PET film/aluminum foil/PE film through adhesive bonding of the laminate to the outside of said bag and perforating one side only of the bag thus formed. Then, the atmosphere in the gas barrier bag was replaced with $CO_2$ gas, so that the concentrations of oxygen and $CO_2$ gas became 0.5% and 97%, respectively in the replaced atmosphere of the bag inside, followed by hermetical heat sealing of the bag. The gas barrier bag in which the amino-acid transfusion bag and the deoxidizing agent package were enclosed was treated by heating at 120° C. for 30 minutes by the use of an air-steam type high-temperature high-pressure sterilizing apparatus and thereafter preserved at 25° C.

During the preservation period, measurements were made of the concentrations of oxygen in the gas barrier bag in the same manner as in Example 3. The results are given in Table 3.

TABLE 3

(Results of preservation test for amino-acid transfusion)

| | Example 3 | Comparative Example 5 |
|---|---|---|
| Packaging method | deoxidizable bag with carbon dioxide gas replacement | deoxidizing agent in gas barrier bag with carbon dioxide gas replacement |
| Oxygen concentration (%) | | |
| 1st day | 0.41 | 1.85 |
| 3rd day | 0.06 | 0.36 |
| 7th day | 0.02 | 0.95 |
| Color tone of amino-acid transfusion | good | remarkably turned brownish |

As is clear from the results in Table 3, in the case of Example 3 in which was employed the deoxidizable bag composed of multi-layer film according to the present invention, in spite of the presence of a large amount of $CO_2$ gas due to $CO_2$ gas replacement, the deoxidization in the preservation system was sufficiently performed, and the amino-acid transfusion bag was kept in a favorable state without any change in the color tone of the transfusion. As opposed to the foregoing, in the case of Comparative Example 5, the oxygen in the bag was not sufficiently absorbed because of the influence of $CO_2$ gas, whereby the amino-acid transfusion was turned broun.

EXAMPLE 4

In a deoxidizable bag same as in Example 3 was housed 150 g of Hizikia fusiformis, an edible seaweed chopped fine, seasoned and mixed with several ingredients containing fried bean curd and bean (hereinafter, abbreviated to "Hizikia mixture"). Then the bag was heat-sealed for hermetical sealing. The deoxidizable bag in which the Hizikia mixture was enclosed was treated by heating at 120° C. for 30 minutes by the use of an air-steam type high-temperature high-pressure sterilizing apparatus and thereafter preserved at 25° C. During the preservation period, measurements were made, at a prescribed interval of days, of the concentrations of oxygen in the deoxidizable bag in which the Hizikia mixture was enclosed. The bag was unsealed on the 7th day from the start of preservation to check for any change in the flavor of the Hizikia mixture. The results are given in Table 4.

Comparative Example 6

In a gas barrier bag (15 mm×200 mm in size) composed of a laminate film of aluminum foil were housed the Hizikia mixture and the deoxidizing agent package same as that prepared in Example 3. Then the gas barrier bag was heat-sealed for hermetical sealing. Thereafter, the procedure in. Example 4 was repeated to heat-treat the gas barrier bag, preserve the same, measure oxygen concentrations and check the result of 7 day preservation. The results are given in Table 4.

TABLE 4

(Results of preservation test for Hizikia mixture)

| | Example 4 | | Comparative Example 6 | |
|---|---|---|---|---|
| Packaging method | deoxidizable bag | | deoxidizing agent in gas barrier bag | |
| Gas concentration (%) | $O_2$ | $CO_2$ | $O_2$ | $CO_2$ |
| 1st day | 0.38 | 4.2 | 0.64 | 4.8 |
| 3rd day | 0.03 | 3.8 | 0.41 | 4.4 |
| 7th day | 0.01 | 3.8 | 0.28 | 3.6 |
| Flavor of Hizikia mixture | good | | remarkably offensive odor | |

As is clear from the results in Table 4, there was recognized the generatrion of $CO_2$ gas from the Hizikia mixture itself during the preservation period. In the case of Example 4, despite $CO_2$ gas generation, the inside of the preservation system was maintained under substantially oxygen-free condition because of favorable absorption of oxygen in the bag, whereby the Hizikia mixture was preserved in a satisfactory state in quality without any change in its flavor. As opposed to the foregoing, in the case of Comparative Example 6, the oxygen in the bag was not sufficiently absorbed because of the influence of $CO_2$ gas, thereby causing qualitative deterioration of the Hizikia mixture accompanied by offensive odor.

What is claimed is:

1. A method for the preservation of an article which comprises preserving an article in a substantially oxygen-free state by the absorption of oxygen in the presence of carbon dioxide gas by housing the article in a packaging vessel or bag and hermetically sealing the packaging vessel or bag, which is at least in part thereof formed from a multi-layer film or sheet comprising (a) an innermost layer containing an oxygen-permeable protective layer, (b) at least one intermediate layer containing an oxygen absorbing resin layer wherein a deoxidizing agent comprising an iron powder and a halogenated metal is kneaded with and dispersed in a thermoplastic resin so that oxygen is absorbed in said oxygen absorbing resin layer, and (c) an outermost layer containing an oxygen barrier layer.

2. The method according to claim 1 wherein after the article is housed in the packaging vessel or bag, then the atmosphere in the packaging vessel or bag is replaced with the carbon dioxide gas and thereafter the packaging vessel or bag is hermetically sealed.

3. The method according to claim 1 wherein the article is an article which generates carbon dioxide gas from itself.

4. The method according to claim 1 wherein after the article is housed in the packaging vessel or bag and after the packaging vessel or bag is hermetically sealed, then the packaging vessel or bag housing the article is heated; or the article is heated in advance and housed in the packaging vessel or bag and thereafter the packaging vessel or bag housing the heated article is hermetically sealed.

5. The method according to claim 1 wherein the concentration of carbon dioxide gas in the packaging vessel or bag after the hermetical sealing of said vessel is at least 1%.

6. The method according to claim 1 wherein the article is preserved at a temperature of 15° C. at the highest in the hermetically sealed packaging vessel or bag.

7. The method according to claim 1 wherein the thermoplastic resin is selected from the group consisting of polyethylene, polypropylene, a propylene/ethylene copolymer, an ethylene/vinyl acetate copolymer, polystyrene, a styrene/butadiene copolymer and a styrene/isoprene copolymer.

8. The method according to claim 7 wherein the iron powder has a particle size of 10 to 50 μm.

9. The method according to claim 8 wherein the halogenated metal is selected from the group consisting of sodium chloride, sodium bromide, sodium iodide, potassium chloride, potassium iodide, potassium bromide, calcium chloride, magnesium chloride and barium chloride.

10. The method according to claim 9 wherein the ratio of the halogenated metal to the iron powder is 0.05 to 50 parts by weight, based on 100 parts by weight of the iron powder.

11. The method according to claim 10 wherein the ratio of the halogenated metal to the iron powder is 0.1 to 20 parts by weight, based on 100 parts by weight of the iron powder.

12. The method according to claim 11 wherein the proportion of the amount of the oxygen absorbent to the amount of the thermoplastic resin is at most 80% by weight.

13. The method of claim 11 wherein the proportion of the amount of the oxygen absorbent to the amount of the thermoplastic resin is 20 to 50% by weight.

14. The method of claim 13 wherein the oxygen absorbing resin layer is in a thickness of 0.1 to 3 mm.

15. The method of claim 14 wherein the oxygen barrier layer comprises a gas barrier resin selected from the group consisting of an ethylene/vinyl alcohol copolymer, nylon, polyvinylidene chloride and aluminum foil.

16. The method of claim 15 wherein the article is preserved at a temperature of 15° C. or lower.

17. The method of claim 15 wherein the article is preserved at a temperature of 10° C. or lower.

18. The method of claim 15 wherein the article is preserved at a temperature of 5° C. or lower.

19. The method of claim 18 wherein the deoxidizing agent comprises iron powder coated with calcium chloride and which is kneaded with polypropylene.

* * * * *